US007357109B2

(12) United States Patent
Mitsuhori et al.

(10) Patent No.: US 7,357,109 B2
(45) Date of Patent: Apr. 15, 2008

(54) INTERNAL COMBUSTION ENGINE AND CONTROL METHOD THEREOF

(75) Inventors: Atsushi Mitsuhori, Kanagawa (JP); Naoki Osada, Kanagawa (JP); Hidehiro Fujita, Kanagawa (JP); Yoshitaka Matsuki, Kanagawa (JP); Masahiko Yuuya, Kanagawa (JP); Tadanori Yanai, Kanagawa (JP); Takatsugu Katayama, Kanagawa (JP); Shouta Hamane, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 197 days.

(21) Appl. No.: 11/318,716

(22) Filed: Dec. 27, 2005

(65) Prior Publication Data

US 2006/0185637 A1 Aug. 24, 2006

(30) Foreign Application Priority Data

Dec. 28, 2004 (JP) ..... 2004-380653

(51) Int. Cl.
*F02N 9/02* (2006.01)

(52) U.S. Cl. ..... 123/179.5; 123/179.18

(58) Field of Classification Search ..... 123/179.3, 123/179.4, 179.5, 179.18, 565; 477/203
See application file for complete search history.

(56) References Cited

U.S. PATENT DOCUMENTS 4,462,348 A * 7/1984 Giardini ..... 123/179.1
5,704,323 A * 1/1998 Gardell et al. ..... 123/179.3
6,050,231 A * 4/2000 Tisch et al. ..... 123/179.1
6,098,585 A * 8/2000 Brehob et al. ..... 123/179.5
6,688,104 B2 * 2/2004 Baeuerle et al. ..... 60/608
6,920,755 B2 * 7/2005 Hoecker et al. ..... 60/612
6,971,357 B2 * 12/2005 Grieser et al. ..... 123/179.18
7,040,304 B2 * 5/2006 Kassner ..... 123/565
2004/0221837 A1 * 11/2004 Kassner ..... 123/565
2005/0000217 A1 * 1/2005 Nau et al. ..... 60/612

FOREIGN PATENT DOCUMENTS

JP 2000-257458 9/2000
JP 2001-159339 6/2001
JP 2004 124753 4/2004

OTHER PUBLICATIONS

English Abstract for JP2004124753.

* cited by examiner

*Primary Examiner*—Terry M. Argenbright
*Assistant Examiner*—Arnold Castro
(74) *Attorney, Agent, or Firm*—Global IP Counselors, LLP

(57) ABSTRACT

Embodiments are disclosed to reliably carry out engine starting without cranking. Using an internal combustion engine 1, when an idle stop condition is established, a third path switching valve 28 that is provided at the connection of the compressed air supply path 25 and a first blow-by path 21, and a blow-by control valve 24 are "closed". The connection of the crankcase to the inlet path 14 is blocked, idling for a designated time is carried out, and finally the engine is stopped. On the other hand, when the idle stop release condition is established, an inlet valve 8 is "opened", and the first to third path switching valves 26 to 28 are "closed", thereby operating a compressor 17 for a designated period of time. Compressed air is thereby supplied to the combustion chamber 2 and the crankcase via the compressed air supply path 25, allowing an increase in the internal cylinder pressure. Finally, the engine is started.

22 Claims, 6 Drawing Sheets

INTERNAL COMBUSTION ENGINE AND CONTROL METHOD THEREOF

RELATED APPLICATION

The disclosure of Japanese Patent Application No. 2004-380653 filed on Dec. 28, 2004, including the specification, drawings and claims, is incorporated herein by reference in its entirety.

FIELD

The present internal combustion engine and control method thereof relate to a technology for improving the starting of the engine (in particular, starting without cranking).

BACKGROUND

Japanese published Patent Application No. H02-271073 illustrates a known technology relating to the starting of an internal combustion engine. Using the disclosed device a direct injection-type cylinder internal combustion engine detects the cylinder in which the piston is beyond the top dead center and has stopped before the exhaust stroke. By injecting fuel and igniting the fuel-air mixture in the cylinder so detected, the engine is started without using an additional starting means such as a cell motor or a coil starter. (in other words, without cranking).

SUMMARY OF THE INVENTION

In the present engine and method combustion chamber pressure is corrected so that the pressure is increased relative to uncorrected pressure to provide a pressure level appropriate for combustion starting of the engine.

The present direct start internal combustion engine comprises a start mechanism for providing a torque powered by a combustion caused by a firing to start the engine from a stopped condition and a pressure correcting mechanism for correcting a combustion chamber pressure in a starting stage so that the pressure is relatively increased.

BRIEF DESCRIPTION OF THE DRAWINGS

For a more complete understanding of the present internal combustion engine and control method thereof, and the advantages thereof, reference is now made to the following description taken in conjunction with the accompanying drawings, in which.

DETAILED DESCRIPTION OF THE ILLUSTRATED EMBODIMENTS

An internal combustion engine is disclosed in which engine rotation is initiated by combustion upon ignition, and which comprises a control means or mechanism for executing at least one control function. A first control function is selectively activated before stopping the engine in order to limit reduction of internal cylinder pressure during the stopping stage of the engine by way of a restraining means or a restraining mechanism, while a second control function is selectively activated before starting the engine in order to raise the internal cylinder pressure of a designated cylinder prior to said combustion. The restraining mechanism may either restrain the combustion chamber pressure from decreasing during the stopping stage or later, or alternatively, actually increase crankcase pressure during the stopping stage so that the combustion chamber pressure is restrained from decreasing in the stopping stage or later. In sum, the control function includes either a pressure correcting means or a pressure correcting mechanism, as discussed in greater detail below, to correct the combustion chamber pressure substantially while generally maintaining the volume of the combustion chamber at least from the moment when the engine is stopped to the time when ignition or firing is carried out to start the engine.

In a first embodiment, by carrying out a control function before the engine has stopped in order to limit reduction of internal cylinder pressure while the engine is inactive (for example, increasing the pressure in the crankcase, or blocking the connection between the crankcase and the open area) and/or by carrying out a control function before the engine is started in order to increase the internal cylinder pressure of the designated cylinder before combustion (for example, supplying compressed air to the combustion chamber of the designated cylinder before combustion), the internal cylinder pressure at startup can be maintained and/or secured at a sufficient level for starting, thereby providing reliable startup without cranking.

Figure 1:
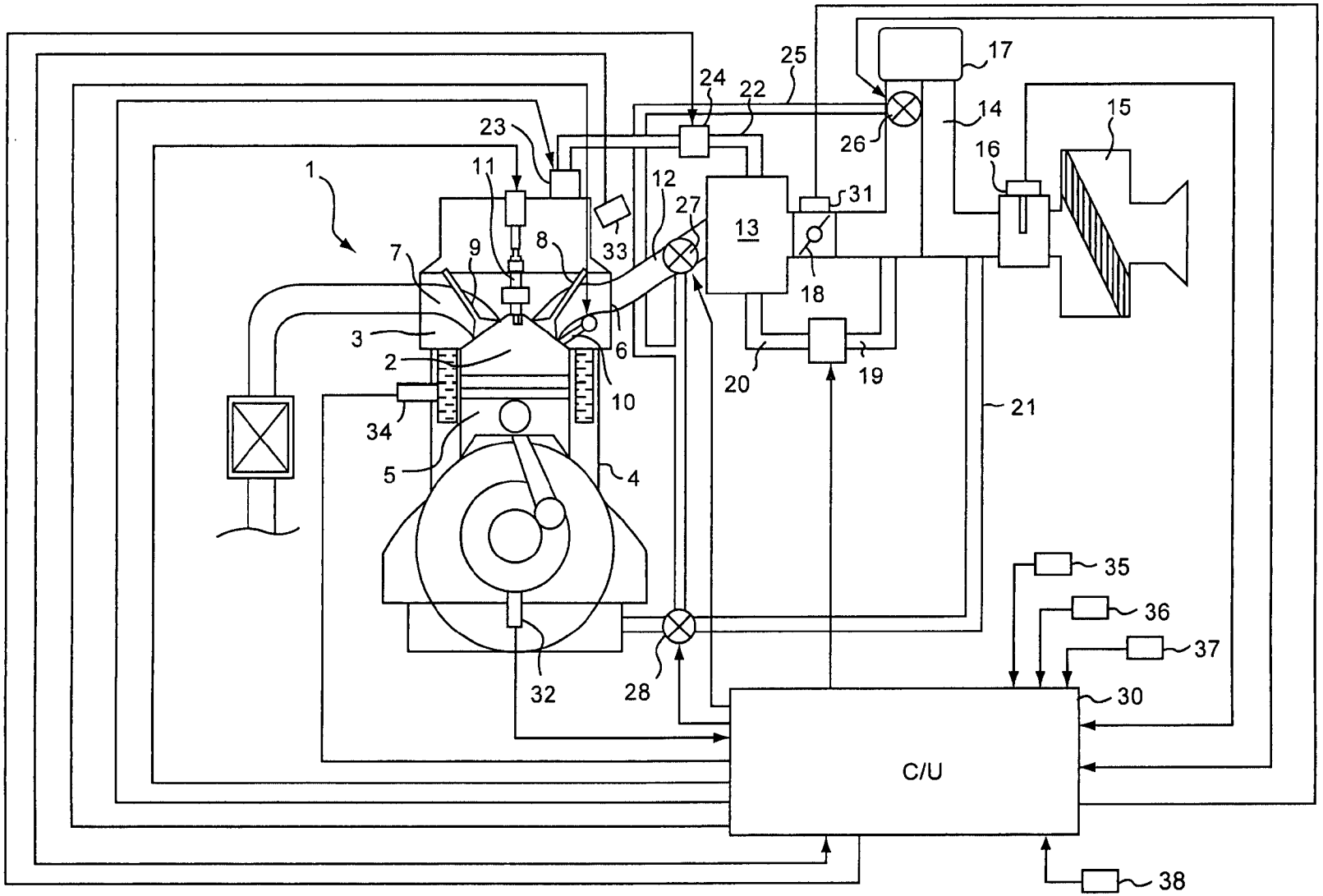
FIG. 1 is a schematic view of a direct injection internal combustion engine.

FIG. 1 is a schematic view of a direct injection internal combustion engine. As shown in FIG. 1, a combustion chamber 2 of the engine 1 comprises a cylinder head 3, a cylinder block 4, and a piston 5 fitted in the cylinder. An inlet port 6 and an exhaust port 7 that open to the combustion chamber 2 are formed in the cylinder head 3, and an inlet valve 8 and an exhaust valve 9 are provided for opening and closing ports 6 and 7. At least the inlet valve 8 is so constructed as to be able to be opened while the engine is inactive. For instance, the inlet valve 8 may employ a so-called electromagnetic valve for electrically carrying out the opening and closing operation. However any other kind of mechanism, that enables the inlet valve 8 to be opened while the engine is inactive may also be employed.

Also provided in the cylinder head 3 and facing the combustion chamber 2 are a fuel injection valve 10 for directly injecting fuel into the combustion chamber 2, and an igniter plug 11 for sparking ignition of the fuel-air mixture in the combustion chamber 2.

An inlet manifold 12 is connected to the inlet port 6, and an inlet path 14 is connected to the upstream side of the inlet manifold 12 via an inlet collector 13. Provided in the inlet path 14 in order upstream of the inlet side are an air cleaner 15 for removing dust, etc. from the intake air, an air flow meter 16 for detecting the flow rate of the intake air, a compressor 17 for compressing and supplying the intake air, and a throttle valve 18 for controlling the flow rate of intake air. While a compressor 17 is specifically disclosed, other forms of high pressure supply such as a high pressure storage unit may be also used.

In the present embodiment the compressor 17 can be operated independently of engine rotation, so that the compressed air can be supplied not only during engine operation but while the engine is inactive.

A bypass path 19 is connected between the inlet path 14 upstream of the throttle valve 18 and the inlet collector 13, bypassing the throttle valve 18, and an idle control valve 20 is provided for controlling the amount of air passing through the bypass path 19.

A first blow-by path 21 is connected between the inlet path 14 upstream of the compressor 17 and the crankcase inside the cylinder block 4, and a second blow-by path 22 connects the rocker chamber in the head cover of the cylinder head 3 and the inlet collector 13. In the second blow-by path 22, a pressure control valve 23 is provided for controlling the pressure of the blow-by gas, and a blow-by control valve 24 is provided for controlling the amount of the blow-by gas.

A compressed air supply path 25 branches out from downstream of the compressor 17 of the inlet path 14 and is connected to the inlet manifold 12 and the first blow-by path 21. In the present embodiment, this pressurized air path 25 branches in two, downstream, with one branch thereof being connected to the middle of the inlet manifold 12 and the other being connected to the middle of the first blow-by path 21. Nonetheless, the path that interconnects the inlet path 14 downstream of the compressor 17 and the inlet manifold 12, and the path that interconnects the inlet path 14 downstream of the compressor 17 and the first blow-by path 21 can be provided separately.

Path switching valves 26, 27 and 28 are provided at the connection of the compressed air supply path 25 and the inlet path 14, the connection of the compressed air supply path 25 and inlet manifold 12, and the connection of the compressed air supply path 25 and the first blow-by path 21. These valves are typically different from those required for normal engine operation. They are closed when possible to minimize pressure reduction and opened when necessary to increase pressure. In one embodiment, they can be electromagnetic driven valves.

The path switching valve (hereinafter referred to as the "first path switching valve") 26 provided at the connection of the compressed air supply path 25 and the inlet path 14 switches between: blocking (closing) of the compressed air supply path 25 to let the compressed air from the compressor 17 flow in the inlet path 14 as is (hereinafter this condition is referred to as the "open" condition of the first path switching valve 26); and blocking (closing) of the inlet path 14 to let the compressed air flow in the compressed air supply path 25 (hereinafter this condition is referred to as the "closed" condition of the first path switching valve 26).

The path switching valve (hereinafter referred to as the "second path switching valve") 27 provided at the connection of the compressed air supply path 25 and the inlet manifold 12 may be switched between: blocking (closing) of the compressed air supply path 25 to let the air that passed the inlet collector 13 flow through the inlet port 6 (hereinafter this condition is referred to the "open" condition of the second path switching valve); and blocking (closing) of the inlet manifold 12 to let the air from the compressed air supplying path 25 flow through the inlet port 6 (hereinafter this condition is referred to as the "closed" condition of the second path switching valve 27).

The path switching valve (hereinafter referred to as the "third path switching valve") 28 provided at the connection of the compressed air supply path 25 and the first blow-by path 21 may be switched between: blocking (closing) the compressed air supply path 25 to let the air from the inlet path 14 (upstream of the compressor 17) flow into the crankcase (hereinafter this condition is referred to as the "open" condition of the third switching valve 28); and blocking (closing) of the first blow-by path 21 to let the air from the compressed air supply path 25 flow into the crankcase (hereinafter this condition is referred to as the "closed" condition of the third switching valve).

During engine operation, pressure control valve 23, blow-by control valve 24, first path switching valve 26, second path switching valve 27 and third path switching valve 28 are all normally in the "open" condition. Therefore, the air that passed the air cleaner 15 goes through the compressor 17, throttle valve 18, inlet collector 13, inlet manifold 12 and inlet port 6 and then is introduced to the combustion chamber 2. At this time, by operating the compressor 17, the amount of intake air can be significantly increased (supercharging of the intake air). In addition, the blow-by gas generated in engine 1 is ventilated by the intake air introduced from the inlet path 14 and led to the inlet collector 13 by the first and second blow-by paths 21 and 22.

In addition to the detection signal of the above-mentioned air flow meter 16, transmitted to a control unit (C/U) 30 are signals from a variety of sensors such as a throttle openness sensor 31 for detecting throttle opening TVO, a crank angle sensor 32, a cam angle sensor 33, a water or coolant temperature sensor 34, a vehicle speed sensor 35, a gear position sensor 36 for detecting the gear position of the transmission, and a brake sensor 37 for detecting operation of the brake (on/off).

The C/U 30 controls the inlet valve 8, exhaust valve 9, fuel injection valve 10, igniter plug 11, compressor 17, throttle valve 18, idle control valve 20, blow-by control valve 24, path switching valves 26, 27 and 28, etc., based on the detected input signals. The C/U 30 can detect engine rotation speed Ne based on the detection signal received from the crank angle sensor 32 as well as identify a cylinder in a specified condition based on the detection signal of the crank angle sensor 32 and cam angle sensor 33.

The C/U 30 executes idle stop control to automatically stop the engine 1 when a specific idle stop condition is established. For example, such a condition is established when the gear position of the transmission is in "drive," that is, the D-range, the brake is on (in operation), and the vehicle speed is zero. When a specific idle stop releasing condition is established during the idle stop (for example, the brake is released after the idle stop condition has been established, or starting operation by the driver is carried out), the idle stop is released and engine 1 is automatically restarted.

Engine 1 is restarted without using the starter (in other words, without cranking) by injecting fuel into the combustion chamber of the cylinder in the expansion mode and by igniting and combusting the fuel-air mixture. However, while the engine is inactive, gas leaks from the combustion chamber by way of the piston ring, etc., and if the internal pressure of the combustion chamber (internal cylinder pressure) is low due to this leakage at the time of starting, even if fuel injection, ignition and combustion are carried out in the detected cylinder, the energy required for startup may not be available.

Therefore in the present embodiment, reduction of the internal cylinder pressure while the engine is inactive is eased (limited) by increasing the internal cylinder pressure before the idle stop, and at engine startup, restarting without cranking is reliably carried out by increasing the internal cylinder pressure before combustion.

Figure 2:
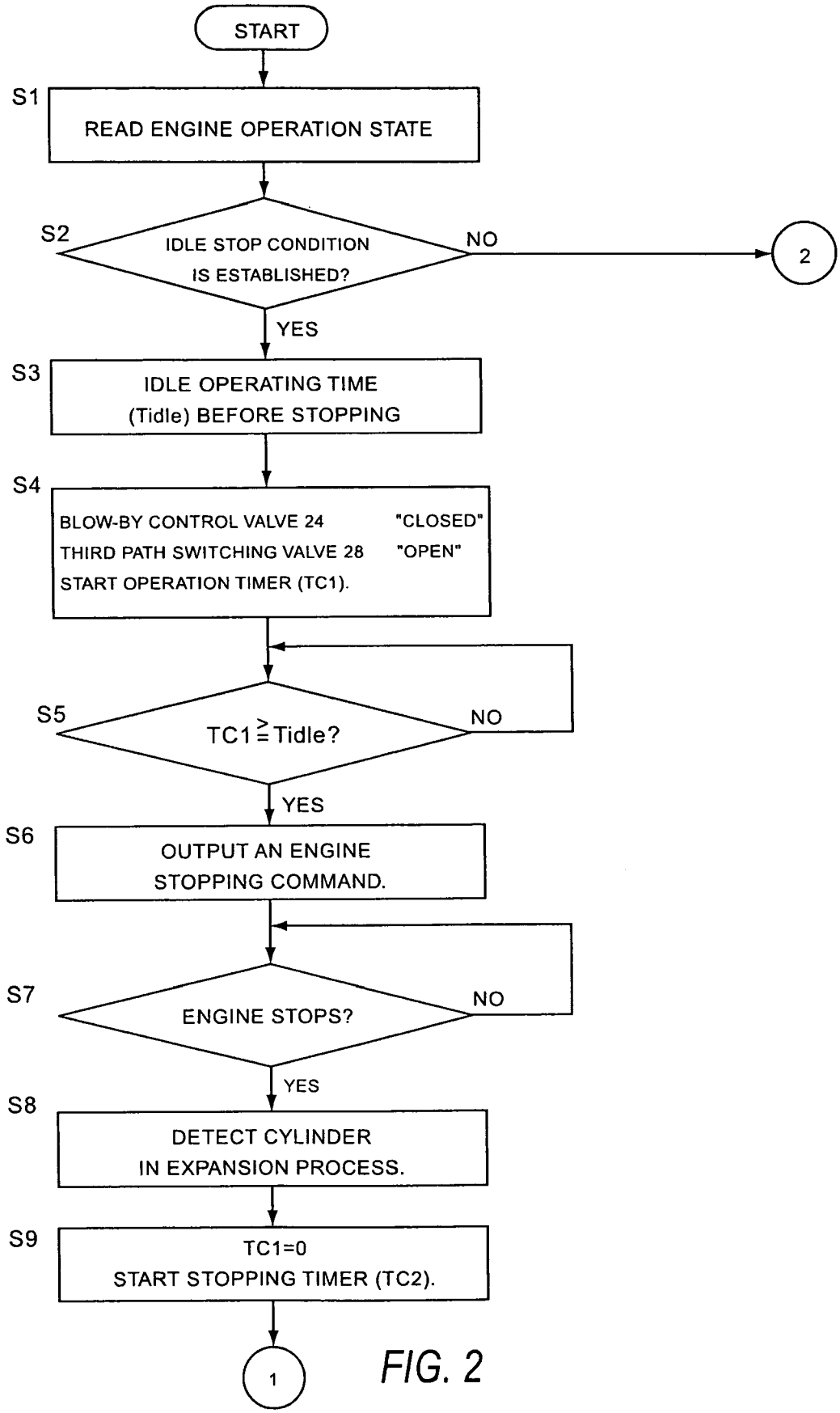
FIG. 2 is a flowchart showing an idle stop control process (engine stop and restart) according to a first embodiment.
Figure 3:
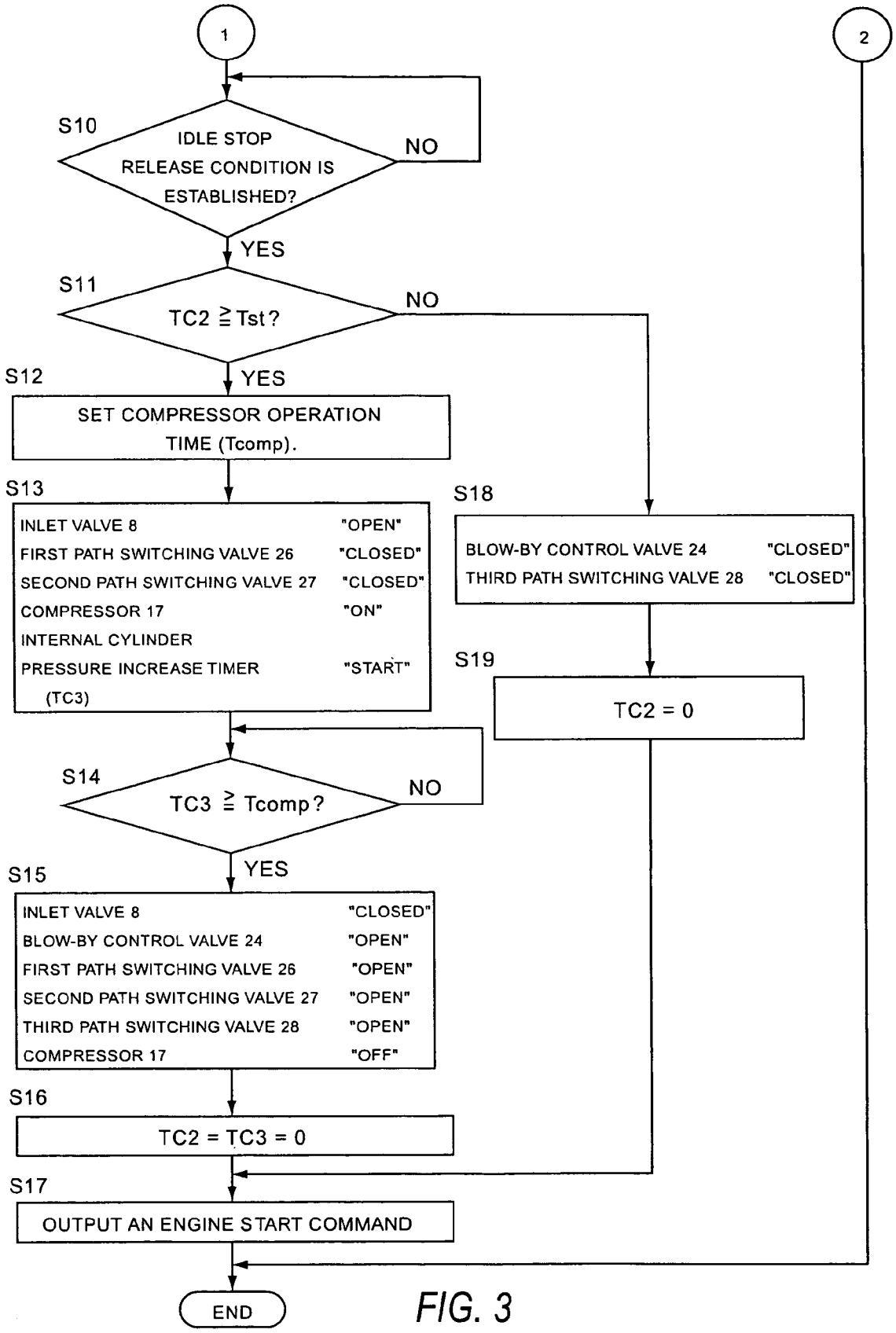
FIG. 3 is a continuation of the flowchart of FIG. 2.

FIGS. 2 and 3 are flowcharts showing the idle stop control process (stopping and restarting of the engine) executed by C/U 30 at every predesignated period of time.

At step S1, the engine operating condition such as engine rotation speed Ne and throttle opening TVO, etc., are read.

At step S2, it is determined whether or not the idle stop condition is established If the idle stop condition is established, the process advances to step S3 and if it is not, the process is terminated. As described above, establishment of the idle stop in the present embodiment requires that (1) the gear position is in the D-range, (2) the vehicle speed is zero (or almost zero), and (3) the brake is engaged (on). Nonetheless, the present engine and method are not limited to these.

At step S3, the idle operating time before stopping (hereinafter referred to as merely the "idle operation time") Tidle is configured. This idle operation time Tidle is equivalent to the time required to increase the pressure in the crankcase to the predesignated pressure by carrying out idle operation under conditions described below. For example, it is established on the basis of the engine operating condition (immediately) before establishment of the idle stop condition read at step S1. Nonetheless Tidle is not so limited but may be set in advance at a fixed value.

At step S4, the blow-by control valve 24 (and the pressure control valve 23, as required) and third path switching valve 28 are "closed" and the countdown of the idle operation timer is started. By doing so, the crankcase and the first blow-by path 21 connected to it are blocked from the ambient space (the compressed air supply path 25 is also blocked) and idling is carried out under these conditions so that the pressure inside the crankcase can be increased.

At step S5, whether the count value TC1 of the idling time has become the idling time Tidle or not (whether TC1=Tidle or not) is determined. If TC1≦Title, the process advances to step S6, and if TC1<Tidle, then idling is continued.

At step S6, the engine stopping command is generated. By doing so, the fuel supply to each cylinder is cut off and the engine is stopped.

At step S7, the stopping of the engine is confirmed, and then the process advances to step S8.

At step S8, the cylinder in the expansion mode is detected. The "closed" condition of the blow-by control valve 24 and the third path switching vale 28 is maintained while the engine is inactive. (Here, the first path switching valve 26 and the second path switching valve 27 remain in the "open" condition.)

At step S9, the count value TC1 of the idle operation timer is reset and in its place the countdown of the stopping time is started. The count value TC2 of this stopping time is equivalent to the elapsed time after the stopping of the engine. However, TC2 is not limited to the function of acting as a "stopping timer".

At step S10 (FIG. 3), it is determined whether or not the idle stop release condition (in other words, the restarting condition) has been established. If the idle stop release condition is established the process advances to step S10, and if not, the engine stopped condition is maintained as is. The idle stop release condition of the present embodiment is established when a starting intention of the driver is detected and as described above, (1) the brake is released and (2) starting operation by the driver is carried out (acceleration operation is carried out). Nonetheless, the process is not so limited.

At step S11, it is determined whether the count value TC2 of the stop timer is greater than or equal to the predesignated value Tst. If TC2>Tst, in other words, the elapsed time since the engine has stopped is greater than or equal to the predesignated time, it is assumed that the internal cylinder pressure has been reduced and the process advances to step S11. When TC1<Tst, in other words, the elapsed time since the engine was stopped is less than the predesignated time, it is assumed that sufficient internal cylinder pressure is present (or not much reduced) to achieve "direct start". Thus, the control process advances to step S18 and step S19, the blow-by control valve 24 and the third path switching valve 28 are "opened", the count value TC2 of the stop time is reset, and then the process advances to step S17. The predesignated value Tst that is used here can be set based on the engine operating status immediately prior to the establishment of the idle stop condition, or it can be set at a fixed value designated in advance.

At step S12, the compressor operation time before injection (hereinafter referred to merely as the "compressor operation time") Tcomp is set. This compressor operation time Tcomp is equivalent to the time required to increase the internal cylinder pressure to a level that will allow startup without cranking by operating the compressor 17 under conditions described below. It is a constant value that is set in advance (of course, it can be a variable by taking into account the environment, etc.)

At step S13, the first path switching valve 26 and the second path switching valve 27 are "closed," the inlet valve 8 of the cylinder in the expansion mode is "opened," the compressor 17 is operated (turned on), and at the same time the countdown of the internal cylinder pressure increase timer is started. If the engine is of a multi-cylinder type, the inlet and exhaust valves in cylinders other than that having the detected or focused-on combustion chamber may be closed to prevent gases in the combustion chamber from leaking. At this time, the blow-by control valve 24 (and the pressure control valve 23) and the third path switching valve 28 remain "closed". Therefore, the compressed air from the compressor 17 goes through the compressed air supply path 25 via the inlet manifold 12 (and inlet valve 8) and first blow-by path 21 to the combustion chamber 2 and crankcase. By doing so, the internal cylinder pressure of the cylinder in the expansion mode can be increased. In particular, the compressed air is supplied to the crankcase and the internal pressure of the crankcase is also increased, so that the internal cylinder pressure can be more effectively increased. The count value TC3 of the internal cylinder pressure increase timer is equivalent to the operation time of the compressor 17 prior to fuel injection (in other words, the time for increasing the internal cylinder pressure).

At step S14, it is determined whether or not the count value TC3 of the internal cylinder pressure increase time is greater than or equal to the predesignated value Tcomp When TC3≧Tcomp, in other words, the operation time of the compressor 17 is the predesignated time or longer, and the internal cylinder pressure is sufficiently increased, the process advances to step S15, and when TC3<Tcomp, the operation of the compressor 17 (increase in the internal cylinder pressure) is continued as is.

At step S15, the operation of the compressor 17 is stopped (turned off) and at the same time, the inlet valve 8 is "closed", the first path switching valve 26, second path switching valve 27 and third path switching valve 28 are "opened," and also the blow-by control valve 24 (together with pressure control valve 23) is "opened".

At step S16, the count value of the stopping timer and the internal cylinder pressure increase timer are reset to zero.

At step S17, the engine startup command is generated. More specifically, the fuel injection command and ignition command are transmitted to the fuel injection valve 10 and igniter plug 11, respectively, of the cylinder in the expansion mode and for which the internal cylinder pressure has been increased as described above.

Figure 4:
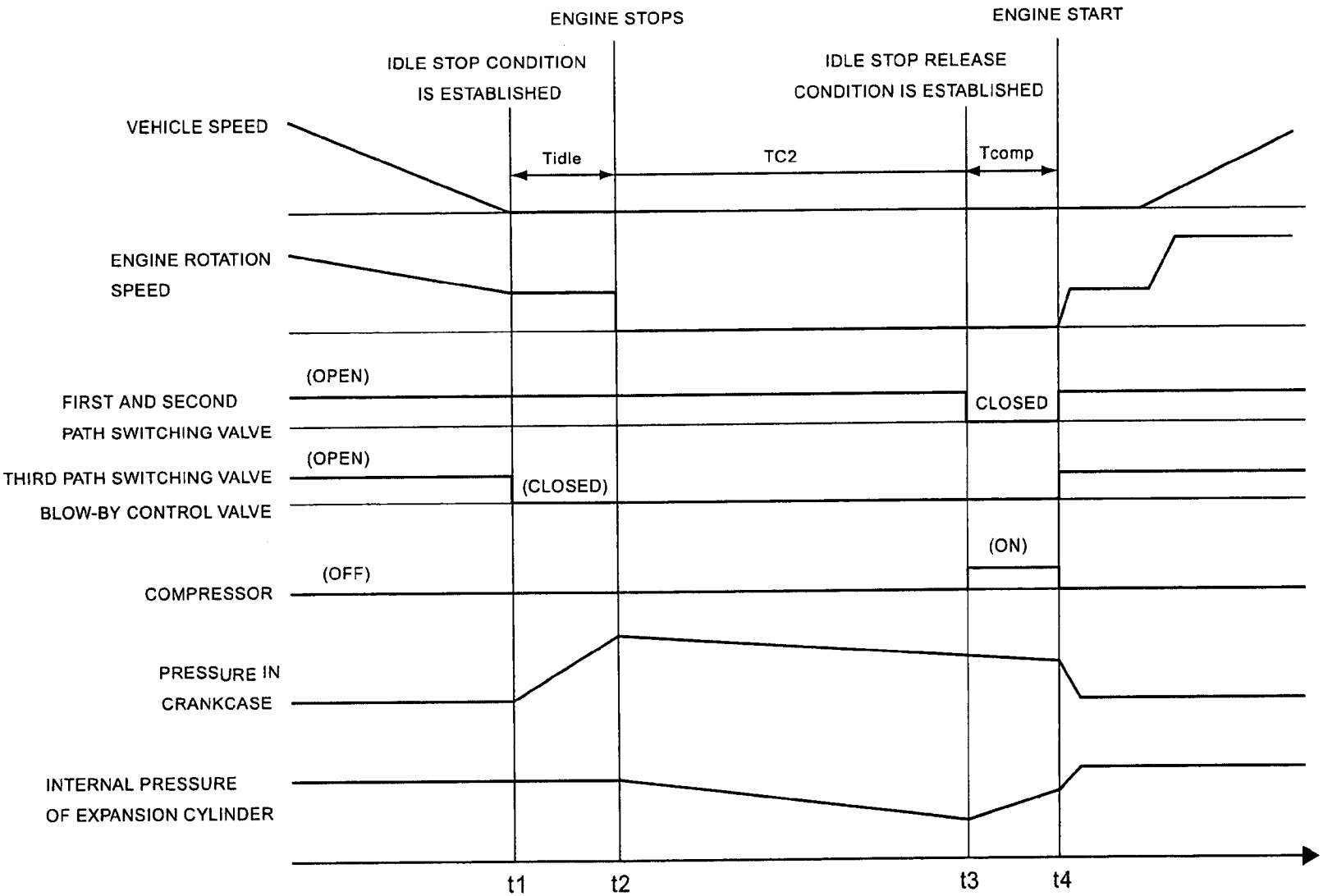
FIG. 4 is a timing chart relating to the idle stop control process.

FIG. 4 is a timing chart relating to the idle stop control process described above. Once the idle stop condition is established (time t1), the blow-by control valve 24 (and pressure control valve 23) and the third path switching valve 28 are closed and the idle operation is continued under these conditions. At this time, the path that connects the crankcase to the ambient space is blocked, so that the pressure inside the crankcase gradually increases. And after the predesignated time (Tidle) has elapsed, the engine is stopped (time t2). The blow-by control valve 24 and the third path switching valve 28 remain "closed" so that reduction of the internal pressure of the crankcase is suppressed.

Then, once the idle stop release condition (restarting condition) is established, (time t3), depending on the length of the period that the engine was inactive (TC2), the process switched to control of restarting. In other words, when the engine stopping time (TC2) is greater than or equal to the predesignated time (Tst), then a great reduction in internal cylinder pressure is expected and the internal cylinder pressure of the cylinder in the expansion mode is increased by supplying compressed air to the combustion chamber 2 and crankcase by "opening" the inlet valve 8, "closing" the first path switching valve 26 and the second path switching valve 27, and turning on the compressor 17. These conditions are maintained for a predesignated period of time (Tcomp) so that the internal cylinder pressure is increased up to a level sufficient for startup (time t4). Then the fuel injection, ignition and combustion are carried out in the cylinder in the expansion mode while inlet valve 8 is "opened", first to third path switching valves 26 to 28 are "opened", and the blow by control valve 24 (and the pressure control valve 23) are "opened"; thus the engine is started. Although it is not shown in the drawing figure, when the engine stopping time (TC2) is below the predesignated time (Tst), it is assumed that reduction of internal cylinder pressure is small and that there is sufficient internal cylinder pressure for startup. Therefore, fuel injection, ignition and combustion are carried out in the cylinder in the expansion mode, and thus the engine is started.

According to the present embodiment, when the idle stop condition is established, the third path switching valve provided at the connection of the compressed air supply path 25 and the first blow-by path 21 and the blow-by control valve are "closed", the connection of the crankcase with the inlet path 14 is blocked, idling for a predesignated time is carried out, the pressure in the crankcase is increased, and finally the engine is stopped. By doing so, it is possible to have a relatively high internal cylinder pressure at restarting after an idle stop. (Naturally, reduction of the internal cylinder pressure can be suppressed.) The third switching valve 28 and the blow-by control valve 24 remain "closed" while the engine is inactive, and therefore reduction of the internal cylinder pressure while the engine is inactive can be effectively suppressed. Thus, a pressure correcting means or mechanism includes a pressure restraining means or mechanism. Thus, startup without cranking can be reliably carried out when restarting from an idle stop.

In addition, when the idle stop release condition is established, compressed air is supplied to the combustion chamber 2 of the cylinder in the expansion mode from the compressor 17 operating independently of rotation of the engine, and the engine is started (in other words, there is combustion) after the internal cylinder pressure is increased, and therefore, startup without cranking can be reliably carried out. Here, an electromagnetic valve is employed as the inlet valve 8. Therefore, even while the engine is inactive, the inlet valve 8 can be "opened" and the compressed air can be supplied to the combustion chamber 2 via the inlet valve 8. In addition, when the inlet valve 8 is "opened", and the first to third path switching valves 26 to 28 are "closed", thereby operating the compressor 17, the compressed air can be supplied not only to the combustion chamber 2 but also to the crankcase, allowing a further efficient increase in the internal cylinder pressure. With a structure having a blow-by path, as in the present embodiment, by having a compressed air supply path 25, first path switching valve 26, second path switching valve 27 and third path switching valve 28, compressed air can be supplied to the combustion chamber 2 and crankcase by using the compressor for intake air supercharging, without having a dedicated compressor. Thus, the pressure correcting means or mechanism includes a pressure increasing means or mechanism.

In addition, the increase in the internal cylinder pressure due to operation of the compressor 17 is carried out when the elapsed time from the stopping of the engine is greater than or equal to the predesignated time, and therefore noise, vibration, etc., can be kept to a minimum.

Figure 5:
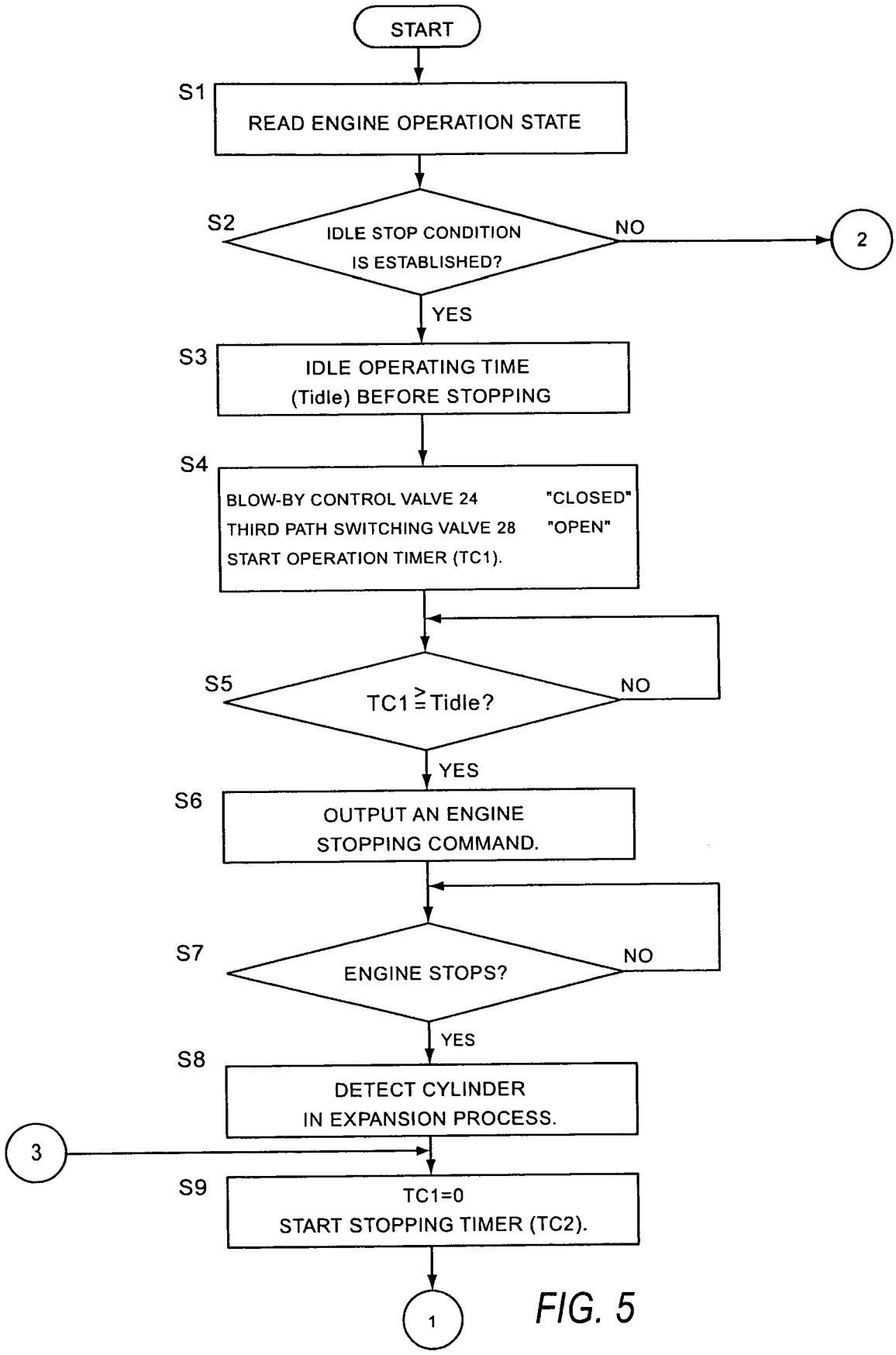
FIG. 5 is a flowchart showing an idle stop control process (engine stop and restart) according to a second embodiment.
Figure 6:
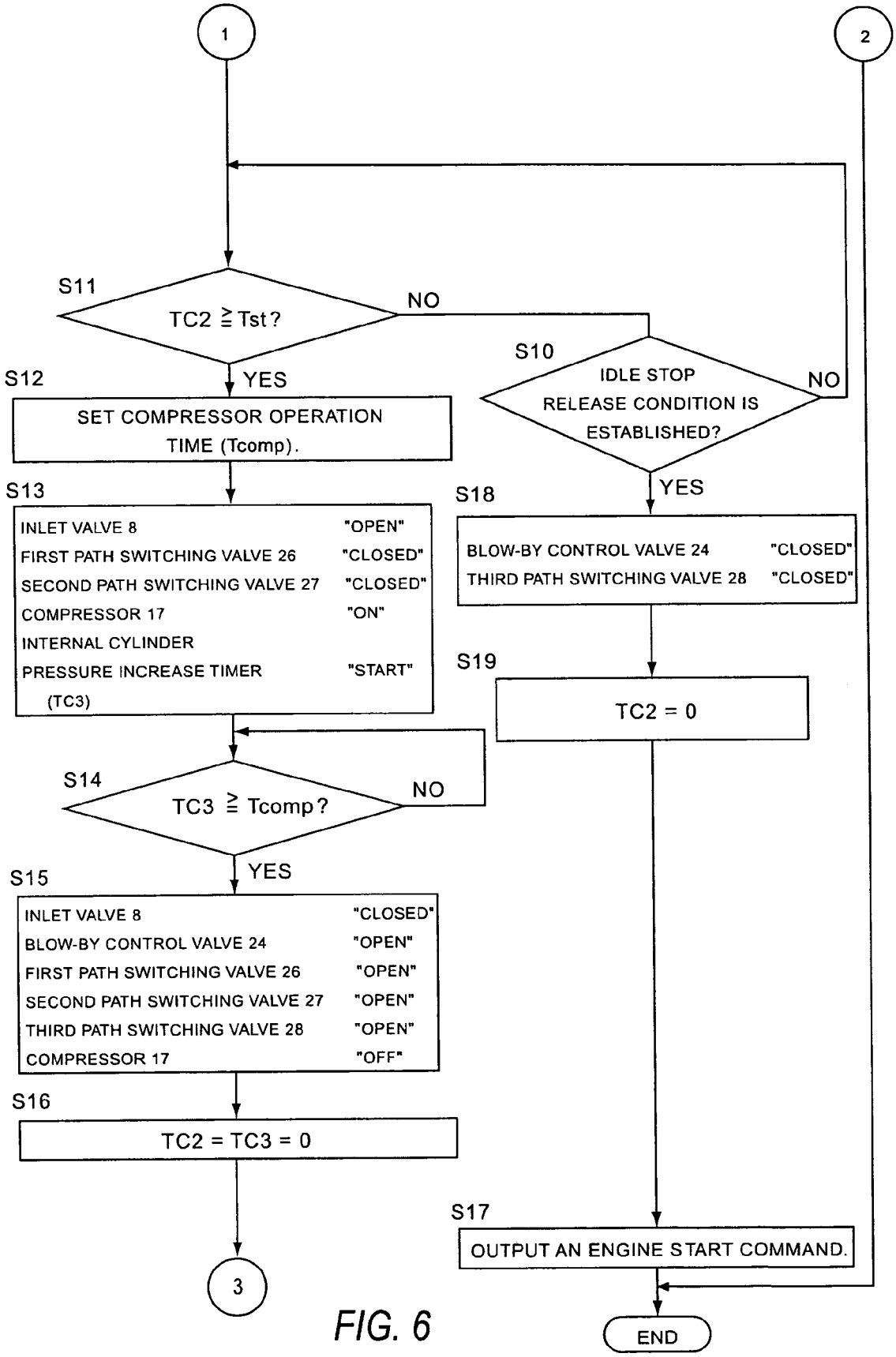
FIG. 6 is a continuation of the flowchart of FIG. 5.

FIGS. 5 and 6 are a flowchart according to a second embodiment that show an idle stop control process executed by C/U 30 at every predesignated period of time. In the second embodiment, the position of step S10, coming between step S11 and step S18, is different from the first embodiment in which step S10 is between step S9 and step S11 (FIGS. 2 and 3). Furthermore, the process advances to step S9 not only from step S8 but also from step S16. In the second embodiment, not only the elapsed time from the stopping of the engine but also the elapsed time from a previous pressure rise is measured, and the combustion chamber pressure is increased whenever the elapsed time is greater than a predetermined elapsed time. Therefore the internal cylinder pressure of the designated cylinder is always raised prior to the combustion are carried out.

In the above-mentioned embodiments, both the control function before stopping the engine in order to limit reduction of the internal cylinder pressure during stopping of the engine (steps S1 to S9), and a control function before starting the engine in order to raise the internal cylinder pressure of the designated cylinder prior to combustion (steps S10 to S17) are carried out. Nonetheless, it is acceptable to carry out only one of these. In addition, the determination, of whether or not to use the control process before engine startup is based on the time elapsed since the engine was stopped (step S11). Nonetheless, it is acceptable that an internal cylinder pressure sensor 38 be provided and a determination can be carried out based on whether the internal cylinder pressure is at or below the predesignated value (in this case, if the detected internal cylinder pressure is at or lower than the predesignated value, it is natural that the above-described control process should be carried out prior to engine startup).

In addition in the above-mentioned embodiments the subject is idle stopping and restarting of an engine. Nonetheless, the control process can be applied to normal engine stopping and/or engine starting. In such a case, the above-described flowcharts can be modified as follows. When applied to normal engine stopping, the process is carried out until the resetting of the idling time in steps S1 to 8 and step S9 (made into a single control process). Then, whether or not the ignition switch is turned off is determined at step S2, and if it is off, the process advances to step S3. Next, when the process is applied to normal engine starting, steps S10 to S19 are carried out (made into a single control process), and then at step S10, it is determined whether or not the ignition switch is turned on, and if it is turned on, the process advances to step S11. By doing so, starting without cranking can be improved for normal engine starting.

In addition a direct injection internal combustion engine is the subject of the above-described embodiments. Nonetheless the present engine and method are not so limited, and the engine can be so structured that fuel remains in the cylinder as in a normal internal combustion engine.

While the present engine and method have been described in connection with certain specific embodiments thereof, this is by way of illustration and not of limitation, and the appended claims should be construed as broadly as the prior art will permit.

What is claimed is:

1. A direct start internal combustion engine comprising:

a start mechanism for providing a torque powered by a combustion caused by a firing to start the engine from a stopped condition; and a pressure correcting mechanism for correcting a combustion chamber pressure in a starting stage so that the pressure is relatively increased, the pressure correcting mechanism including a restraining mechanism for restraining the combustion chamber pressure from decreasing in a stopping stage or later by selectively closing a passage leading from a crankcase.

2. The engine as claimed in claim 1, wherein the pressure is relatively increased while generally maintaining combustion chamber volume.

3. The engine as claimed in claim 1, wherein the passage comprises a blow-by passage and a valve to gate the blow-by passage, and the restraining mechanism selectively maintains the valve closed while the engine is in the stopped condition.

4. The engine as claimed in claim 1, wherein the restraining mechanism increases crankcase pressure in the stopped condition so that the combustion chamber pressure is restrained from decreasing in the stopped condition or later.

5. The engine as claimed in claim 4, wherein the restraining mechanism selectively idles the engine in the stopping stage so as to increase crankcase pressure.

6. The engine as claimed in claim 1, wherein the pressure correcting mechanism is a pressure increasing mechanism for increasing the combustion chamber pressure before the engine starts.

7. The engine as claimed in claim 6 further comprising:

a valve operable while the engine is in the stopped condition, and a high pressure air supply operable independently of rotation of the engine, and wherein the increasing mechanism selectively uncloses the valve to connect the high pressure air supply to the combustion chamber, combustion being selectively carried out to start the engine, and wherein the high pressure air supply is selectively operated to increase the combustion chamber pressure before the engine is started.

8. The engine as claimed in claim 7, further comprising:

a passage connecting the crankcase to the high pressure supply, and wherein crankcase pressure is increased by selectively operating the high pressure supply before the engine starts.

9. The engine as claimed in claim 7, wherein the high pressure supply is a compressor for supercharging intake air when the engine is operated.

10. The engine as claimed in claim 6, further comprising:

a timer for timing elapsed time from a moment when the stopped condition starts or when a previous pressure increasing is carried out, and wherein the combustion chamber pressure is selectively increased when the elapsed time is larger than a predetermined elapsed time.

11. The engine as claimed in claim 6, further comprising:

a determiner for determining actual combustion chamber pressure, and wherein the combustion chamber pressure is selectively increased when the actual combustion chamber pressure is lower than a predetermined actual combustion chamber pressure.

12. A vehicle comprising the engine as claimed in claim 6, wherein the vehicle comprises a detector for detecting an intention of a driver to start the vehicle from a vehicle stopped condition, and the combustion chamber pressure is selectively increased when the detector detects the intention.

13. The vehicle as claimed in claim 12, wherein the vehicle is an idling stop vehicle, and the detector detects the intention based on release of a brake during an idling stop.

14. The engine as claimed in claim 1, wherein the combustion chamber whose pressure is corrected is in an expansion stroke.

15. A vehicle comprising the engine as claimed in accordance with claim 1.

16. A method of direct start for an internal combustion engine, comprising:

providing torque powered by combustion caused by firing to start the engine from a stopped condition, correcting a combustion chamber pressure in a starting stage so that the pressure is increased relative to uncorrected pressure; and restraining the combustion chamber pressure from decreasing in a stopping stage or later by closing a passage leading from a crankcase.

17. The method as claimed in claim 16 comprising:

correcting the combustion chamber pressure by increasing the combustion chamber pressure before the engine is started.

18. The method as claimed in claim 16 comprising;

determining actual combustion chamber pressure.

19. The method as claimed in claim 16 comprising:

increasing the combustion chamber pressure when the actual combustion chamber pressure is lower than a predetermined actual combustion chamber pressure.

20. The method as claimed in claim 16 comprising:

closing the intake valve after the increase in pressure within the combustion chamber and prior to firing.

21. The method as claimed in claim 16 comprising:

detecting an intention of a driver to start the vehicle from a vehicle stopped condition, wherein the combustion chamber pressure is selectively increased when the detector detects the intention.

22. The method as claimed in claim 21 wherein the detecting of the intention of the driver includes detecting the intention based on a release of a brake during an idling stop.

* * * * *